US012129732B2

(12) United States Patent
Lyle

(10) Patent No.: US 12,129,732 B2
(45) Date of Patent: Oct. 29, 2024

(54) ROTATING CONTROL DEVICE HAVING IMPROVED SEAL

(71) Applicant: Noble Rig Holdings Limited, Sugar Land, TX (US)

(72) Inventor: Orlan Lyle, Seabrook, TX (US)

(73) Assignee: NOBLE RIG HOLDINGS LIMITED, Sugar Land, TX (US)

( * ) Notice: Subject to any disclaimer, the term of this patent is extended or adjusted under 35 U.S.C. 154(b) by 0 days.

(21) Appl. No.: 18/392,661

(22) Filed: Dec. 21, 2023

(65) Prior Publication Data

US 2024/0200421 A1 Jun. 20, 2024

Related U.S. Application Data

(63) Continuation of application No. PCT/US2022/034391, filed on Jun. 21, 2022.

(60) Provisional application No. 63/213,451, filed on Jun. 22, 2021.

(51) Int. Cl.
*E21B 33/08* (2006.01)

(52) U.S. Cl.
CPC ..... *E21B 33/085* (2013.01)

(58) Field of Classification Search
CPC ..... E21B 33/085
See application file for complete search history.

(56) References Cited

U.S. PATENT DOCUMENTS

| | | | | |
|---|---|---|---|---|
| 2,192,805 | A * | 3/1940 | Mervyn | E21B 33/06 277/352 |
| 10,138,700 | B1 * | 11/2018 | Pruitt | E21B 33/085 |
| 10,344,552 | B2 | 7/2019 | Reinhardt | |
| 2008/0106045 | A1 | 5/2008 | Lembcke | |
| 2016/0258239 | A1 | 9/2016 | Clark | |
| 2018/0058169 | A1 * | 3/2018 | Le | E21B 17/01 |
| 2021/0348470 | A1 * | 11/2021 | Tenorio | E21B 33/085 |
| 2024/0084664 | A1 * | 3/2024 | Clark | E21B 33/085 |

OTHER PUBLICATIONS

International Search Report and Written Opinion, International Application No. PCT/US2022/034391 issued Oct. 5, 2022.

* cited by examiner

*Primary Examiner* — James G Sayre
(74) *Attorney, Agent, or Firm* — Richard A. Fagin

(57) ABSTRACT

A rotating control device has a rotating section rotatably supported in a housing. The rotating section has a mandrel and a rotating seal element of a rotary seal sealingly affixed to an exterior of the mandrel. The housing has sealingly disposed therein a non-rotating seal element of the rotary seal. The non-rotating seal element is in at least partial axial and radial alignment with the rotating seal element and is movable longitudinally with respect to the housing. The non-rotating seal element has a protrusion extending from a face disposed toward the rotating seal element. Fluid pressure acting on the non-rotating seal element acts on a larger surface area on a face opposed to the rotating seal element than on the face disposed toward the rotating seal element.

10 Claims, 5 Drawing Sheets

ROTATING CONTROL DEVICE HAVING IMPROVED SEAL

CROSS REFERENCE TO RELATED APPLICATIONS

Continuation of International Application No. PCT/US2022/034391 filed on Jun. 21, 2022. Priority is claimed from U.S. Provisional Application No. 63/213,451 filed on Jun. 22, 2021.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable.

BACKGROUND

The present disclosure relates to the field of rotary well drilling. More specifically, the disclosure relates to fluid pressure control devices used in connection with such well drilling.

Rotary well drilling, e.g., for petroleum production, includes extending a "string" of drilling tools at the end of an axially elongated "string" of pipe for such purpose. During rotary well drilling, the pipe string is rotated (or certain tools attached to or within the pipe string may alternatively or additionally perform such rotation) to cause a drill bit at the end of the pipe string or tool string to turn. Turning the drill bit and axially urging the bit is performed to extend the well by boring through subsurface rock formations. As the well is extended, an annular space (annulus) is created between the interior surface of the drilled well (the "borehole") and the exterior surface of the pipe string and string of well tools. Drilling fluid ("mud") may be circulated through an interior passage in the pipe string and tool string, out from nozzles or courses in the drill bit, and into the annular space, for among other purposes, to lift drill cuttings to the surface, to provide fluid pressure to control fluid entry into the borehole and to maintain the mechanical stability of the borehole.

It may be necessary from time to time to close the annular space so that fluid under pressure cannot escape the well. Such times may include the need to control an unexpected influx of fluid into the borehole from a formation, or to perform so-called managed pressure drilling, wherein the fluid in the annular space is pressurized at the surface, in order to maintain greater than hydrostatic pressure on the formations exposed to the borehole. Rotating control devices (RCDs for convenience hereinafter), also referred to as "rotating control heads", "rotating diverters", "rotating blowout preventers" and "rotating annular preventers", among other names, provide a mechanism to close the annular space to fluid flow from the well, thus providing a safety barrier, and in managed pressure drilling to enable the drilling operator to control fluid pressure in the annular space to a more precise degree than is practical by changing the density of the drilling fluid. At the same time, the pipe string may be rotated in order to undergo regular drilling operations requiring rotation of the pipe string and/or tool string.

Various implementations of RCDs are described in a number of U.S. Patents, for example, U.S. Pat. No. 7,487,837 issued to Bailey et al, and U.S. Pat. No. 9,004,181 issued to Hannegan et al. An element common to many types of RCDs is a rotating elastomer seal, although RCD systems are known which include static seals. For example, as disclosed in International Application Publication No. WO 2019/118394 filed by Johnson et al., FIG. 5A therein shows a partial cross-sectional view of an annular control device (ACD—another synonym for a rotating control device) annular sealing system (e.g., 300 of FIG. 3 in the WO '394 publication) with a dual seal sleeve 200 and drill pipe 330 disposed therein, where an upper annular packer system 310a and a lower annular packer system 310b are in a disengaged state. The ACD annular sealing system typically includes redundant sealing elements 100a and 100b that are engaged or disengaged at the same time. When the upper annular packer system 310a and the lower annular packer system 310b are disengaged, an upper annular packer 420a and a lower annular packer 420b are disengaged, and the upper sealing element 100a and lower sealing element 100b are relaxed such that the annulus surrounding drill pipe 330 is unsealed.

Continuing, FIG. 5B of the WO '394 publication shows a partial cross-sectional view of the ACD annular sealing system with a dual seal sleeve 200 and drill pipe 330 disposed therein, where the upper annular packer system 310a and the lower annular packer system 310b are in an engaged state. As noted above, while redundant sealing elements 100a and 100b are typically engaged or disengaged at the same time, the upper annular packer system 310a and the lower annular packer system 310b may be operated independently of one another. When the upper annular packer system 310a is engaged, a hydraulically actuated piston 510a travels, causing the elastomer or rubber portion of the upper annular packer 420a to travel within an upper radiused housing 410a. When sufficiently engaged, the upper annular packer 420a causes the upper sealing element 100a to make contact, and form an interference fit with the drill pipe 330. Specifically, the upper seal insert 120a and upper buffer material 130a make contact and form an interference fit with a circumference of the drill pipe 330. Similarly, when the lower annular packer system 310b is engaged, a hydraulically actuated piston 510b travels causing the elastomer or rubber portion of the lower annular packer 420b to travel within the lower radiused housing 410b. When sufficiently engaged, the lower annular packer 420b causes the lower sealing element 100b to make contact, and form an interference fit with the drill pipe 330. Specifically, the lower seal insert 120b and the lower buffer material 130b make contact and form an interference fit with the circumference of the drill pipe 330.

Continuing further, FIG. 5C of the WO '394 publication shows a partial cross-sectional view of the ACD annular sealing system with the dual seal sleeve 200 and the drill pipe 330 disposed therein, where the upper annular packer system 310a and the lower annular packer system 310b are in an engaged state and lubrication is injected into a lubrication chamber 550 via a lubrication injection port 320. When the well is being drilled ahead, the lubricant pressure in the lubrication chamber 550 may be maintained just above wellbore pressure by injecting lubrication fluid 530 that may be comprised of, for example, active drilling mud, into the cavity (not independently illustrated). The hydraulic closing pressures (not shown) of the upper annular packer system 310a and the lower annular packer system 310b of the ACD annular sealing system that are configured to engage the upper sealing element 100a and the lower sealing element 100b, respectively, may be adjusted independently to maintain the desired lubricant pressure within the lubrication chamber 550. The lubrication fluid 530 cools and lubricates the upper sealing element 100a and the lower sealing element 100b. Because of the rotation of the drill pipe 330 and the imperfect seal formed by the sealing elements 100a and 100b, the injected lubrication fluid 530 that lubricates lower sealing element 100b may eventually work its way below the lower sealing element 100b and join the return flow of fluids (not shown) to the choke manifold (not shown) disposed on the surface (not shown). The lubrication fluid 530 that lubricates the upper sealing element 100a may be collected in the drilling fluid trip tank (not shown). In one or more embodiments of the present invention, the hydraulic closing pressures (not shown) of the upper annular packer system 310a and the lower annular packer system 310b of the ACD annular sealing system may be actively and independently adjusted to maintain the annular seal (not independently illustrated).

A related structure is disclosed in European Patent No. 2295712 filed in the name of Weatherford Lamb, Inc.

The foregoing is intended to illustrate the importance of and typical operation of example annular seals or rotating control devices used in well pressure control, and is not intended to limit the scope of the present disclosure in any way.

In view of the importance of well annular pressure control, and the essential aspect of RCDs (by whatever name is used to identify the device), there is a need for improved seal elements in such devices.

SUMMARY

One aspect of the present disclosure is a rotating control device having a rotary seal. A rotating control device according to this aspect of the disclosure has a rotating section rotatably supported in a housing. The rotating section has a mandrel and a rotating seal element of a rotary seal sealingly affixed to an exterior of the mandrel. The housing has sealingly disposed therein a non-rotating seal element of the rotary seal. The non-rotating seal element is in at least partial axial and radial alignment with the rotating seal element and is movable longitudinally with respect to the housing. The non-rotating seal element has a protrusion extending from a face disposed toward the rotating seal element. Fluid pressure acting on the non-rotating seal element acts on a larger surface area on a face opposed to the rotating seal element than on the face disposed toward the seal element.

Some embodiments further comprise at least one biasing element disposed between the face opposed to the rotating seal element and a bearing retainer longitudinally supporting the non-rotating seal element in the housing.

In some embodiments, the at least one biasing device comprises a spring.

In some embodiments, the rotating seal element and the non-rotating seal element comprise a rotary face seal.

In some embodiments, the rotary face seal comprises at least one of plastic, metal or metal covered by a wear resistant exterior surfacing.

In some embodiments, the non-rotating seal element comprises an external seal engaged with an interior surface of an annular space in the housing.

In some embodiments, the external seal comprises an o-ring.

In some embodiments, the rotating seal element comprises an internal seal engaged with an exterior surface of the mandrel.

In some embodiments, the rotating seal element comprises an o-ring.

In some embodiments, the fluid pressure enters an interior of the housing through a fluid passage disposed between the mandrel and the housing, on an opposed side of the non-rotating seal element in face contact with the rotating seal element.

Other aspects and possible advantages will be apparent from the description and claims that follow.

DETAILED DESCRIPTION

Figure 1:
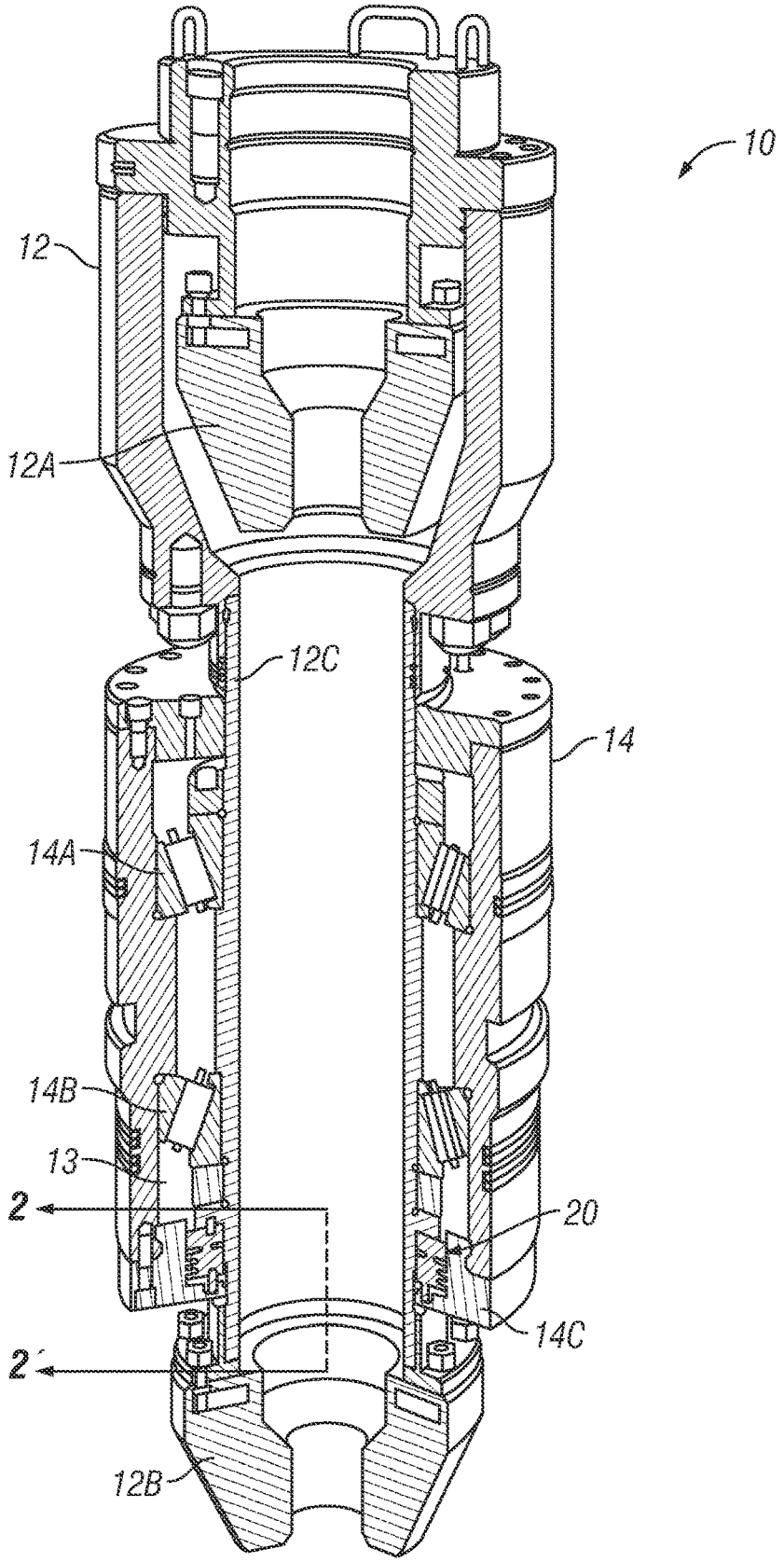
FIG. 1 shows a cut away view of an example embodiment of a rotating control device (RCD).

An example embodiment of a rotating control device (RCD) that may have a rotary seal according to the present disclosure is shown in cut away view in FIG. 1. FIG. 1 shows only some of the principal functional components of the RCD 10 for clarity of the illustration. Other components that may otherwise be present when the RCD 10 is connected to a drilling apparatus, such as fluid line connections and fluid flow lines, are omitted from FIG. 1. A rotating section 12 comprising an upper pipe seal (e.g., an elastomer seal referred to as a "stripper rubber") 12A, a mandrel 12C and a lower pipe seal (which may also be an elastomer seal and referred to as a "stripper rubber") 12B are interconnected to rotate together as a unit, i.e., the rotating section 12 of the RCD 10. The rotating section 12 is rotatably supported inside a housing, e.g., a bearing housing 14. The example embodiment in FIG. 1 may comprise an upper bearing 14A and a lower bearing 14B to rotatably support the rotating section 12, e.g., along the mandrel 12C, within the bearing housing 14. The bearing housing 14 may be disposed within a pressure tight pipe, case or housing (not shown in FIG. 1) having connection features for coupling the RCD 10 to or within the drilling apparatus (not shown) as the RCD 10 would ordinarily be used during well construction operations. Omitted for clarity are seals disposed on the exterior of the bearing housing 14 to stop movement of fluid axially along or past the exterior of the bearing housing 14. As will be appreciated by those skilled in the art, such seals (not shown) and/or related devices such as connecting features (also not shown) provide that the RCD 10 may be sealingly coupled within such apparatus as a drilling riser (not shown), whereby annular space in a well between the well wall and a drill string may be closed to fluid flow by the RCD 10.

A rotary seal 20 may be disposed in an annular space 13 between the interior of the bearing housing 14 and the exterior of the rotating section 12 to prevent fluid from a well (not shown) coupled below the bearing housing 14 from entering the annular space 13 during well construction operations, thus protecting the lower bearing 14B and the upper bearing 14A from such well fluid and closing a possible fluid path to the atmosphere from the well (not shown). Details of the rotary seal 20 are shown in more detail in FIG. 2, as identified in the inset part of FIG. 1 so indicated.

Figure 2:
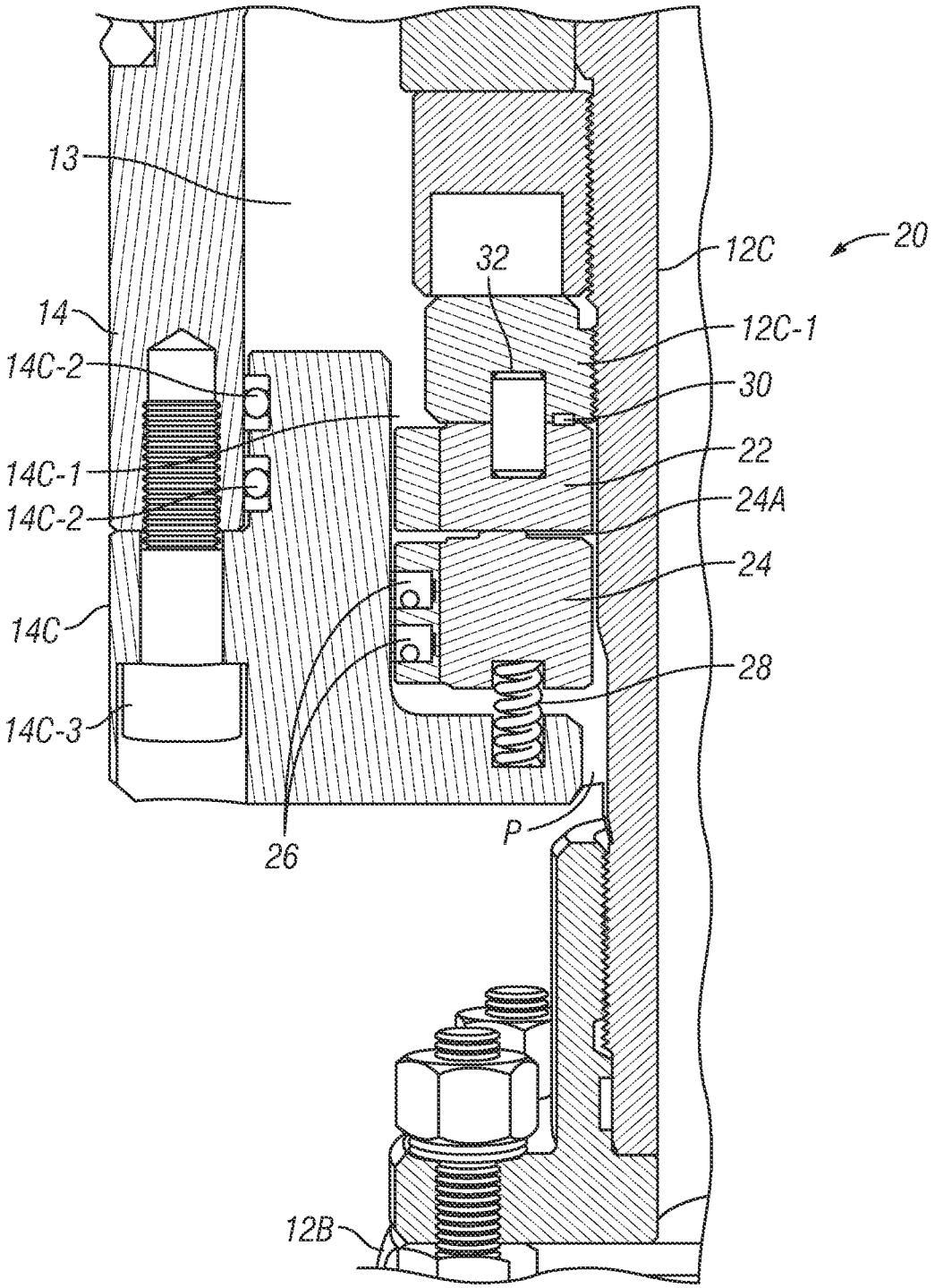
FIG. 2 shows an enlarged cross-section view of a rotary seal of the RCD of FIG. 1 to illustrate a seal according to the present disclosure.
Figure 4:
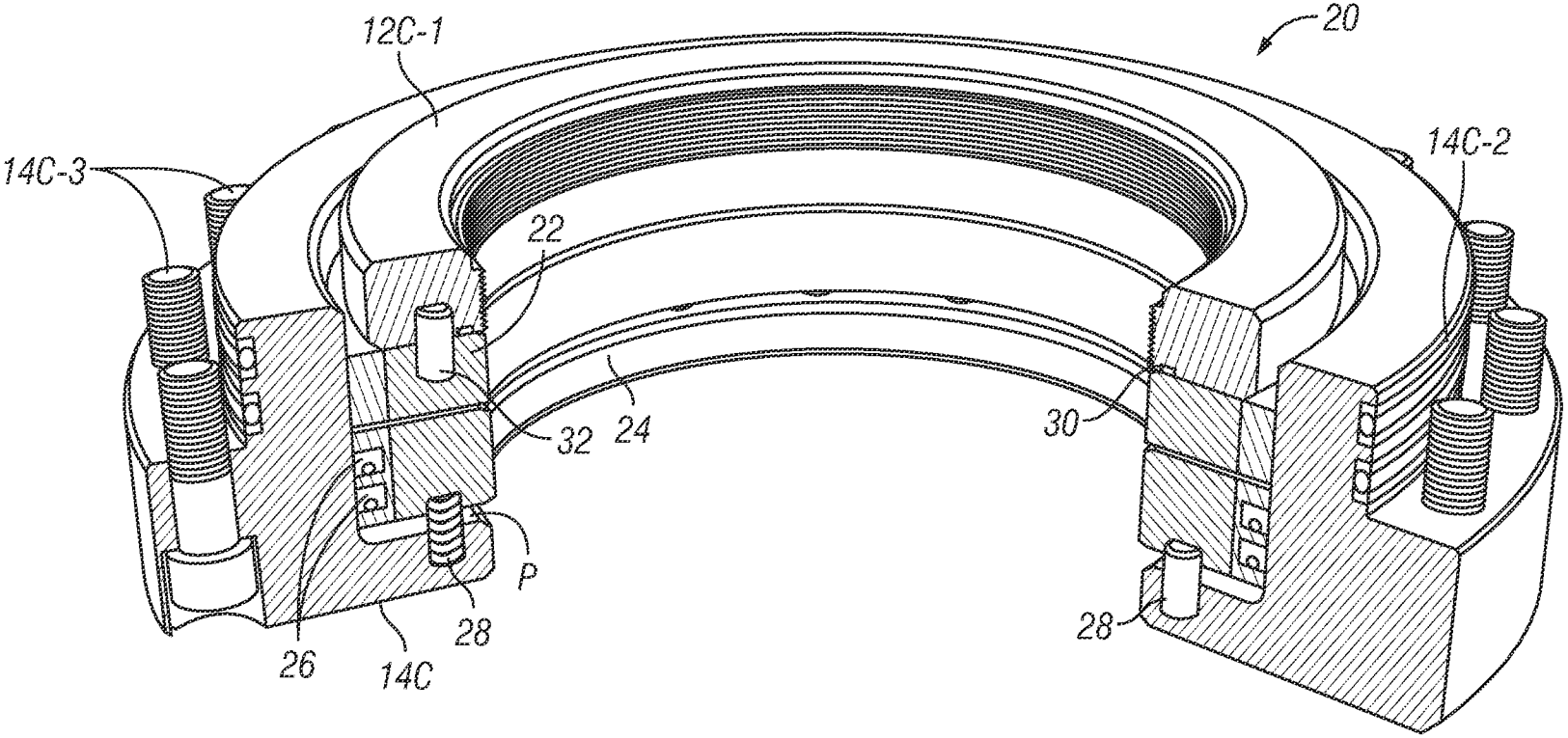
FIG. 4 shows a perspective view of the rotary seal in FIG. 2 in assembled form.
Figure 5:
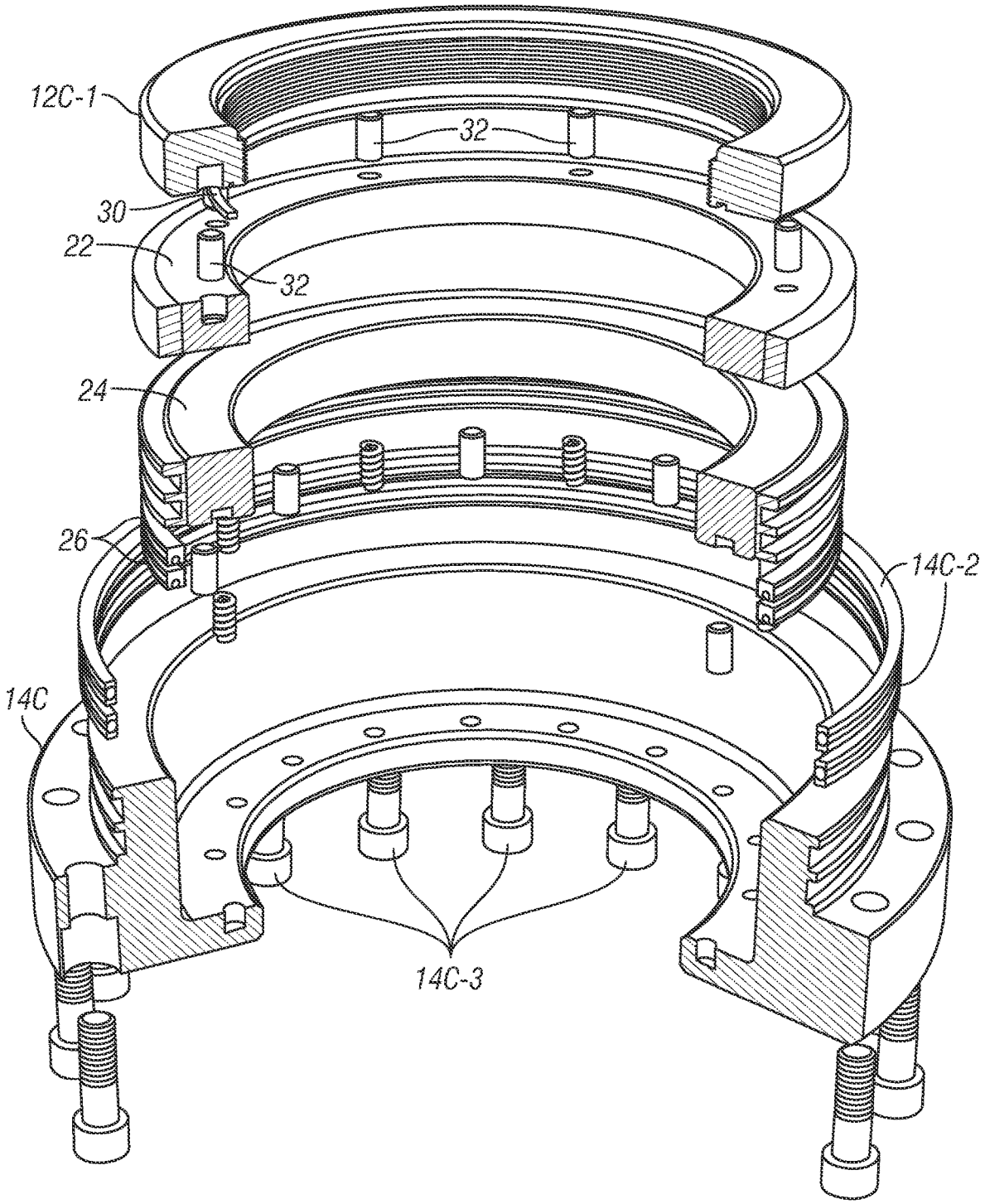
FIG. 5 shows an exploded view of the rotary seal of FIG. 4 from a similar perspective as FIG. 4.

FIG. 2 shows an example embodiment of the rotary seal 20 and surrounding components of the RCD (10 in FIG. 1) in more detail in a partial cross-sectional view. The following description is made with reference to FIG. 2, however like components having like reference numerals are also shown in perspective view in FIG. 4 and in exploded view in FIG. 5, and the following description applies equally to such drawing figures.

The rotary seal 20 may comprise a non-rotating seal element 24 such as a part of a face seal, and a rotating seal element 22 such as the other part of a face seal. The non-rotating face seal element 24 and the rotating face seal element 22 may be made from any material known in the art to be used for rotary face seals, e.g., metals, rigid plastics and metals having wear resistant exterior material surfacing or coating. The material(s) from which the face seal elements 22, 24 are made may be rigid and may be machinable to close tolerances. The non-rotating seal element 24 and the rotating seal element 22 are in sufficient axial and radial alignment such that respective faces may be urged into contact with each other to form a rotating face seal. The example embodiment shown in FIG. 2 comprises full radial and axial alignment of the rotating seal element 22 and the non-rotating seal element 24, however such full alignment is not a limitation on the scope of the present disclosure.

The non-rotating seal element 24 may be sealingly supported within an axial end, e.g., the lower end of the bearing housing 14 by a seal retainer 14C having a suitable recess 14C-1 formed in its interior. The seal retainer 14C may be sealed to prevent fluid movement within the bearing housing 14 by one or more seals 14C-2, e.g., o-rings. The seal retainer 14C may be held in place in the bearing housing 14 in any manner known in the art, one example of which is shown in FIG. 2 as capscrews 14C-3, however the manner of attaching the seal retainer 14C to the bearing housing 14 is not a limitation on the scope of the present disclosure.

The non-rotating seal element 24 may be sealed within the interior of the seal retainer 14C by one or more seals 26, e.g., o-rings to stop fluid movement past the rotary seal 20 to the annular space 13 by way of the exterior of the non-rotating seal element 24. The non-rotating seal element 24 may comprise on its upper surface a protrusion 24A to make contact with the lower surface of the rotating seal element 22. A result of having the protrusion 24A will be further explained with reference to FIG. 3. The non-rotating seal element 24 may be supported longitudinally from the base of the bearing retainer 14 by one or more biasing elements, e.g., springs 28, to urge the non-rotating seal element 24 into face contact with the rotating seal element 22 in the absence of fluid pressure. Fluid pressure may enter the rotary seal 20 from a passage P below the rotary seal 20. Thus, the non-rotating seal element 24 is free to move longitudinally within the seal retainer 14C.

The rotating seal element 22 may be attached to the mandrel 12C by a seal adapter 12C-1. The seal adapter 12C-1 may be threadedly engaged to the exterior of the mandrel 12C for convenience of assembly and disassembly of the rotating seal element 22 to the mandrel 12C. One or more dowel pins 32 may be used to rotationally couple the rotating seal element 22 to the seal adapter 12C-1 such that rotation of the mandrel 12C during well construction operations is transferred to the rotating seal element 22. The rotating seal element 22 may be sealed against the seal adapter 12C-1 by one or more seals such as o-rings 30 to stop fluid movement past the interior of the rotating seal element 22 into the annular space 13. Fluid movement between the mandrel 12C and the bearing adapter 12C-1 may be stopped by suitable choice of threads for connecting the bearing adapter 12C-1 to the mandrel 12C, or any other suitable form of seal for such purpose may be used in some embodiments.

Figure 3:
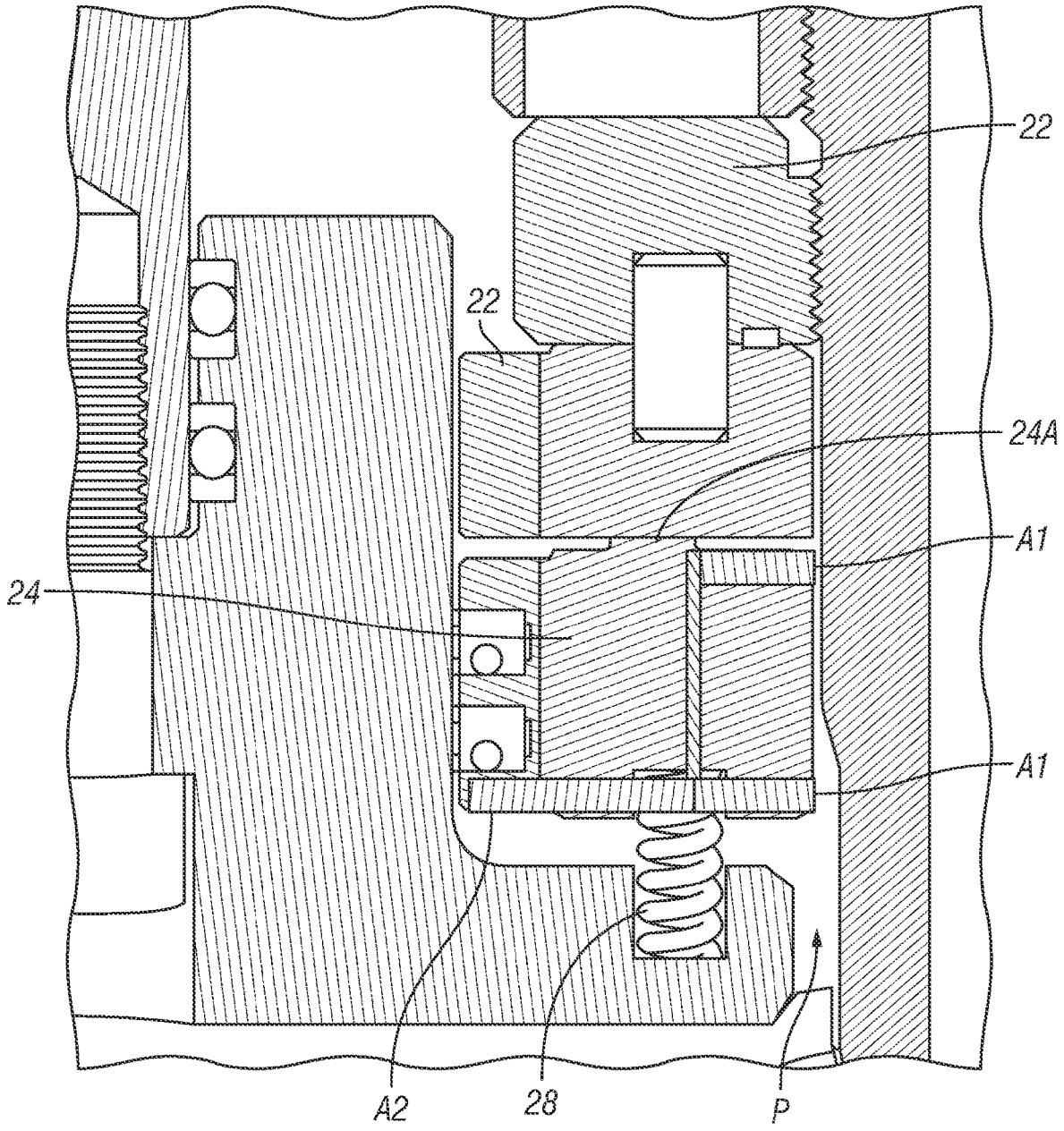
FIG. 3 shows a detail view of the rotary seal of FIG. 2 to illustrate pressure paths and pressure-induced forces acting on the seal.

In use, the rotary seal 20 may, by reason of the above described structure, ultimately stop fluid movement from the passage P into the annular space 13 by contact between the rotating seal element 22 and the non-rotating seal element 24. Referring to FIG. 3, because the non-rotating seal element 24 comprises the protrusion 24A, fluid under pressure entering the passage P may act on the entire lower face of the non-rotating seal element 24, defined by areas A2 and A1. Area A2 represents the portion of surface area of the non-rotating seal element 24 that is inboard of the protrusion 24A, plus the equivalent surface area of the protrusion 24A. Area A1 represents the portion of the surface area that is outboard of the protrusion 24A. Thus, area A1 is exposed to fluid pressure on both sides of the non-rotating seal element 24. Area A2, by reason of the protrusion 24A is exposed to fluid pressure in the passage P only on one side of the non-rotating seal element 24. A corresponding net longitudinal force applied to the non-rotating seal element 24, denoted by F, may be therefore related to the fluid pressure applied to the passage P by the relationship $F=P*A^2$, such net force being exerted against the rotating seal element 22. Such net force is generated as a result of the different cross-sectional area exposed to fluid pressure on opposed sides of the rotating seal element 24. Correspondingly, when little or no fluid pressure is applied to the rotary seal 20, the longitudinal force applied to the non-rotating seal element 24 is limited only to the force applied by the spring(s) 28. In this way, rotating face seal contact force and resulting wear by reason of contact between the protrusion 24A and the rotating seal element 22 may be minimized.

In light of the principles and example embodiments described and illustrated herein, it will be recognized that the example embodiments can be modified in arrangement and detail without departing from such principles. The foregoing discussion has focused on specific embodiments, but other configurations are also contemplated. In particular, even though expressions such as in "an embodiment," or the like are used herein, these phrases are meant to generally reference embodiment possibilities, and are not intended to limit the disclosure to particular embodiment configurations. As used herein, these terms may reference the same or different embodiments that are combinable into other embodiments. As a rule, any embodiment referenced herein is freely combinable with any one or more of the other embodiments referenced herein, and any number of features of different embodiments are combinable with one another, unless indicated otherwise. Although only a few examples have been described in detail above, those skilled in the art will readily appreciate that many modifications are possible within the scope of the described examples. Accordingly, all such modifications are intended to be included within the scope of this disclosure as defined in the following claims.

What is claimed is:

1. A rotating control device, comprising:

a rotating section rotatably supported in a housing, the rotating section comprising a mandrel and a rotating seal element of a rotary seal, the rotating seal element sealingly affixed to an exterior of the mandrel; and wherein the housing has sealingly disposed therein a non-rotating seal element of the rotary seal, the non-rotating seal element being in at least partial axial alignment and partial radial alignment with the rotating seal element, the non-rotating seal element being movable longitudinally with respect to the housing, the non-rotating seal element comprising a protrusion extending from a face of the non-rotating seal element disposed toward the rotating seal element wherein fluid pressure acting on the non-rotating seal element acts on a larger surface area on a face opposed to the rotating seal element than on a face of the non-rotating seal element disposed toward the rotating seal element.

2. The rotating control device of claim 1 further comprising at least one biasing element disposed between the face opposed to the rotating seal element and a bearing retainer longitudinally supporting the non-rotating seal element in the housing.

3. The rotating control device of claim 2 wherein the at least one biasing device comprises a spring.

4. The rotating control device of claim 1 wherein the rotating seal element and the non-rotating seal element comprise a rotary face seal.

5. The rotating control device of claim 4 wherein the rotary face seal comprises at least one of plastic, metal or metal covered by a wear resistant exterior surfacing.

6. The rotating control device of claim 1 wherein the non-rotating seal element comprises an external seal engaged with an interior surface of an annular space in the housing.

7. The rotating control device of claim 6 wherein the external seal comprises an o-ring.

8. The rotating control device of claim 1 wherein the rotating seal element comprises an internal seal engaged with an exterior surface of the mandrel.

9. The rotating control device of claim 8 wherein the rotating seal element comprises an o-ring.

10. The rotating control device of claim 1 wherein the fluid pressure enters an interior of the housing through a fluid passage disposed between the mandrel and the housing, on an opposed side of the non-rotating seal element in face contact with the rotating seal element.

* * * * *